United States Patent [19]

Seaman

[11] Patent Number: 4,632,047

[45] Date of Patent: Dec. 30, 1986

[54] KNIFE ASSEMBLY FOR BELT LOOP TACKER

[75] Inventor: A. Matthew Seaman, Brentwood, Tenn.

[73] Assignee: Cutters Exchange, Inc., Nashville, Tenn.

[21] Appl. No.: 630,189

[22] Filed: Jul. 12, 1984

[51] Int. Cl.[4] ..... D05B 37/04; D05B 23/00

[52] U.S. Cl. ..... 112/121.27; 83/620; 112/130

[58] Field of Search ..... 83/620; 112/104, 121.22, 112/121.27, 122, 130

[56] References Cited

U.S. PATENT DOCUMENTS

| | | | |
|---|---|---|---|
| 4,075,954 | 2/1978 | Hintzen et al. | 112/130 X |
| 4,114,544 | 9/1978 | Miyachi et al. | 112/104 |
| 4,227,470 | 10/1980 | Mitchell et al. | 112/130 X |
| 4,287,842 | 9/1981 | Breck, Jr. | 112/121.27 |
| 4,366,764 | 1/1983 | McCurry | 112/121.27 |
| 4,385,571 | 5/1983 | Breck, Jr. | 112/121.27 |
| 4,502,399 | 3/1985 | Seaman | 112/121.27 |
| 4,516,460 | 5/1985 | Vizecky | 83/620 X |

*Primary Examiner*—Wm. Carter Reynolds
*Attorney, Agent, or Firm*—Harrington A. Lackey

[57] ABSTRACT

A knife assembly for cutting an elongated web into belt loop strips for a belt loop sewing or tacker machine. The knife assembly has a blade configuration including a plurality of knife blades diverging in opposite directions along the feed path of the web. For each cutting operation, not only is the web of belt loop material severed to form a leading piece and a trailing portion, but the laterally opposite corner portions of the trailing end of the leading piece and the leading end of the trailing portion are trimmed, prior to the formation of a belt loop from each successive leading piece of belt loop material.

12 Claims, 13 Drawing Figures

KNIFE ASSEMBLY FOR BELT LOOP TACKER

BACKGROUND OF THE INVENTION

This invention relates to a belt loop sewing apparatus, and more particularly to a knife assembly for cutting a web of belt loop material into belt loop strips.

Apparatus for forming belt loops from strips of web material by folding the ends of the belt loop strips, and for attaching the formed loops to garments, are well known in the art, as illustrated in the following U.S. patents:

U.S. Pat. No. 3,699,907—Anderson et al.—Oct. 24, 1972
U.S. Pat. No. 4,048,931—Hodgins—Sep. 20, 1977
U.S. Pat. No. 4,114,544—Miyachi et al.—Sep. 19, 1978
U.S. Pat. No. 4,137,857—Miyachi et al.—Feb. 6, 1979
U.S. Pat. No. 4,287,842—Breck, Jr.—Sep. 8, 1981
U.S. Pat. No. 4,385,571—Breck, Jr.—May 31, 1983

Anderson and both Miyachi patents disclose pivotally mounted straight cutter blades for co-acting with a straight stationary blade in order to transversely cut the web of belt loop material into strips.

The Hodgins U.S. Pat. No. 4,048,931 discloses a guillotine-action cutter having a straight blade for transversely cutting the web of belt loop material.

In both of the Breck patents, the belt loop strips are precut, and fed as independent belt loop strips to the turning or folding apparatus. The strips are turned at their ends to form the belt loop strips. In the Breck U.S. Pat. No. 4,385,571 (FIG. 10) the independent belt loop strips 40 are secured end-to-end by threads, which must be cut by a pivotal cutter blade 242.

When the ends of a belt loop strip are cut transversely, straight across the web, and then the ends are turned in upon themselves, for subsequent stitching to the garment, the cut ends of the threads or fibers in the in-turned ends of the belt loop strip tend to spread or fan out so that they project laterally outward beyond the width of the stitched belt loop. Such spread fibers are not only unsightly, but tend to fray and unravel from the belt loop.

SUMMARY OF THE INVENTION

It is therefore an object of this invention to provide a knife assembly for a belt loop tacker machine, particularly adapted for transversely severing a web of belt loop material in such a manner that the cut ends of each belt loop have their laterally opposed corner portions trimmed or removed. When the ends of the belt loop strip with their corner portions removed, are turned inward, the severed threads of the in-turned ends are completely concealed when stitched to the garment.

In order to sever such webs for producing belts loops with trimmed end corners, a knife assembly is provided incorporating a blade member having a configuration in which blades or blade portions diverge in opposite feed directions of the web, so that when the cutting operation is executed, the web is not only severed transversely into two portions, but the adjacent cut ends of the web portions have their opposed corner portions removed or trimmed.

The knife assembly made in accordance with this invention preferably includes a knife head having a plurality of straight slots in an X-configuration to receive four straight blades, one pair of which are substantially V-shaped to diverge in the feed direction of the belt web, and the other pair of blades are arranged in a V-shaped configuration to diverge in the opposite direction from the belt feed. In this manner, when all four blades are driven downward simultaneously and transversely through the belt web, the web is completely severed and the corner portions are removed.

The knife member is timed with the web feeding apparatus so that when the knife head is in its elevated inoperative position, an increment of web is fed past the cutting station to the folding station in which the feed increment is equal to the desired length of the belt loop strip. The belt feed is then interrupted to hold the web in a stationary position while the knife head descends to sever the web and trim the corners. The cycle is repeated to successively produce uniform belt loop strips having both ends trimmed of their corner portions.

Preferably, each of the blades in the knife head is uniform, and therefore interchangeable, or independently removable and replaceable.

DESCRIPTION OF THE PREFERRED EMBODIMENT

Figures 1, 4, 5, 6, 7, 8:
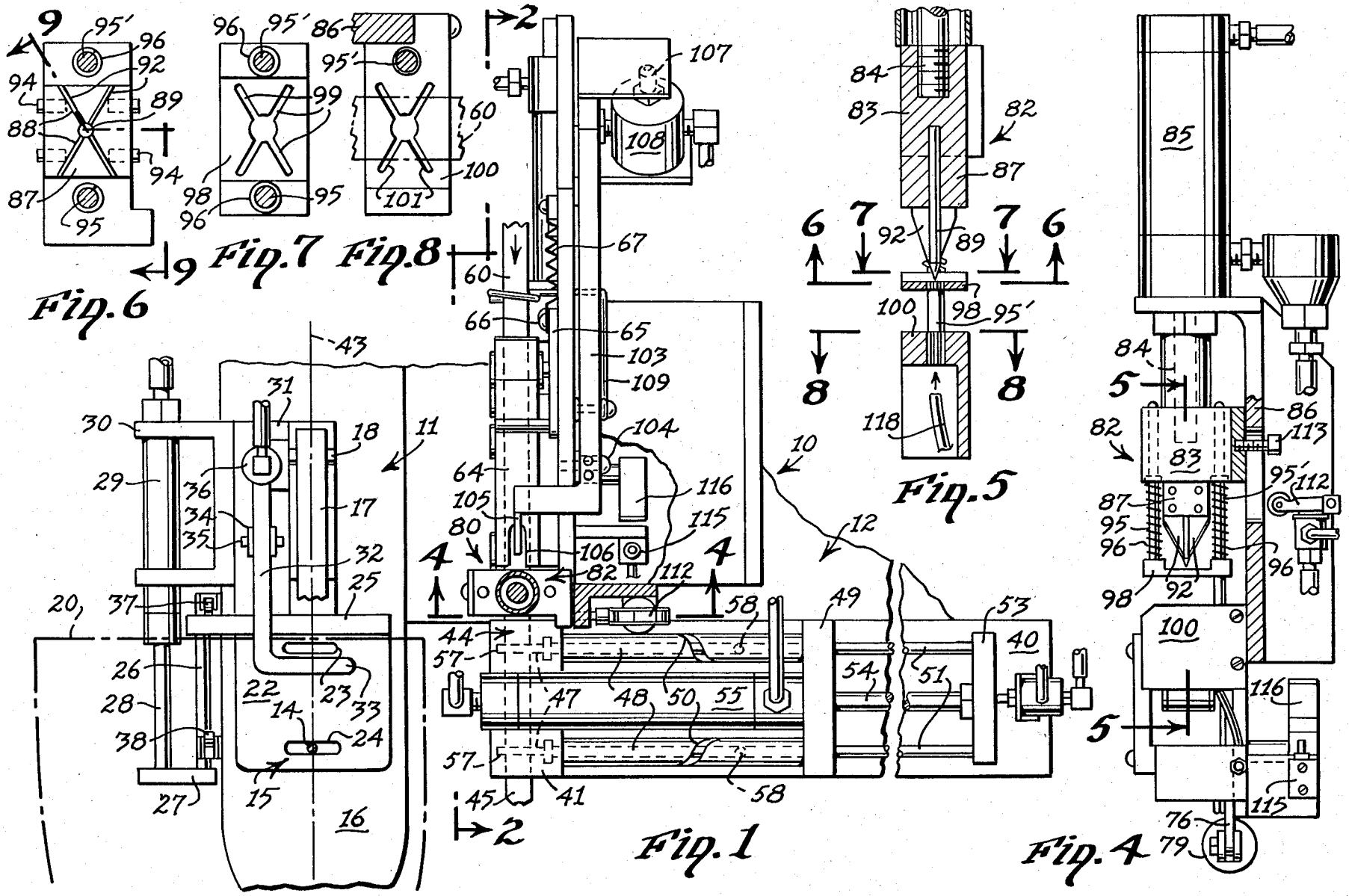
FIG. 1 is a top plan view of a belt loop sewing apparatus incorporating a knife assembly made in accordance with this invention.
FIG. 4 is an enlarged fragmentary section taken along the line 4—4 of FIG. 1.
FIG. 5 is a fragmentary section taken along the line 5—5 of FIG. 4.
FIG. 6 is an enlarged section taken along the line 6—6 of FIG. 5.
FIG. 7 is an enlarged section taken along the line 7—7 of FIG. 5.
FIG. 8 is an enlarged section taken along the line 8—8 of FIG. 5.

Referring now to the drawings in more detail FIG. 1 discloses a belt loop tacker or sewing apparatus 10, including the combination of a belt loop sewing machine 11 and a loading apparatus 12.

The sewing machine 11 includes a needle 14 mounted for vertical reciprocable movement in a sewing station 15 over a platform 16.

The platform 16 carries a presser foot arm 17 supporting a presser foot, now shown. The opposite end of the presser foot arm 17 is pivotally mounted by a pin 18 to a stationary part of the machine 11, such as the platform 16. The presser foot, not shown, operates in a known manner for clamping the work piece such as a garment or pair of pants 20 during the stitching operation.

Mounted for slideable movement longitudinally of the platform 16 is a shift plate 22 having a pair of longitudinally spaced transverse needle openings 23 and 24. The shift plate 22 is fixed to a transverse bar 25. Projecting forward from the bar 25 is a rod 26 connected to a cross head 27, which is in turn connected to a piston rod 28 reciprocable within the pneumatic cylinder 29 carried by the cylinder bracket 30 which is fixed to the platform 16. Extending rearwardly from the transverse bar 25 is a rear slide plate 31, which moves longitudinally and reciprocably with the transverse bar 25. The slide plate 31 supports a longitudinally extending auxiliary arm 32, the free end of which constitutes an auxiliary clamp 33. The auxiliary arm 32 is pivotally mounted on a block 34 by a pivot pin 35. The rear end of auxiliary arm 32 is adapted to be retracted upward by an auxiliary cylinder 36 fixed to the rear slide plate 31.

Limit switches 37 and 38 may be provided on the side of the platform 16 to limit the longitudinal travel of the transverse bar 25, and thereby the longitudinal movement of the shift plate 22.

The loading apparatus 12 includes a support plate 40 upon one end of which is mounted a receiver head 41. The receiver head 41 includes an elongated receiver slot 42, (FIGS. 2 & 3) extending longitudinally and parallel to the longitudinal axis 43 of the stitching station 15. Both ends of the slot are open, as well as the side opposing the sewing machine 11, to define a loading station or belt loop forming station 44, for receiving an elongated belt loop strip 45 cut to a predetermined length.

A pair of cylindrical rod passageways 47 are formed in the side wall of the receiver head 41, parallel to each other and opening into the slot 42 within the receiver head 41. Fixed to and projecting coaxially from the passageways 47 are a pair of parallel tubular guide members 48, preferably cylindrical and hollow. The right ends of the cylindrical guide members 48, as viewed in FIG. 1, are supported by a block 49.

Formed in each cylindrical wall of the tubular guide members 48 is a cam slot 50, a portion of which has a spiral configuration, as illustrated in U.S. Pat. No. 4,502,399 of A. Matthew Seaman, and owned by the Assignee of this application. Received in each of the tubular guide members 48 for longitudinal coaxial reciprocable movement is an elongated turning rod 51. Each turning rod 51 extends through the respective rod passageways 47 and into the transverse slot 42 within the receiving head 41. The opposite ends of the rods 51 are connected to a cross head 53, which in turn is connected to a piston rod 54 reciprocable within a pneumatic cylinder 55. Thus, by actuation of the fluid cylinder 55, the rods 51 are caused to reciprocate coaxially within the respective cylindrical guide members 48.

The free end of each of the turning rods 51 terminates in a respective turning finger member 57 having a spaced pair of parallel turning fingers or tines, for receiving between the tines the belt loop strip 45.

Each turning rod 51 is provided with a cam or cam stud 58 projecting radially from each respective turning rod 51 and received within the respective can slot 50. Thus, as each turning rod 51 travels longitudinal through the corresponding tubular guide member 48, each of the turning finger members 57 is moved toward the sewing machine 11, carrying with them the belt loop strip 45. As the finger members 57 travel toward the sewing machine 11, the finger members 57 simultaneously turn the ends of the belt loop strip to present the belt loop strip 45 with its inturned ends beneath the needle 14 for successive stitching of each end of the belt loop 45.

Figures 2, 3, 9, 10, 11, 12, 13:
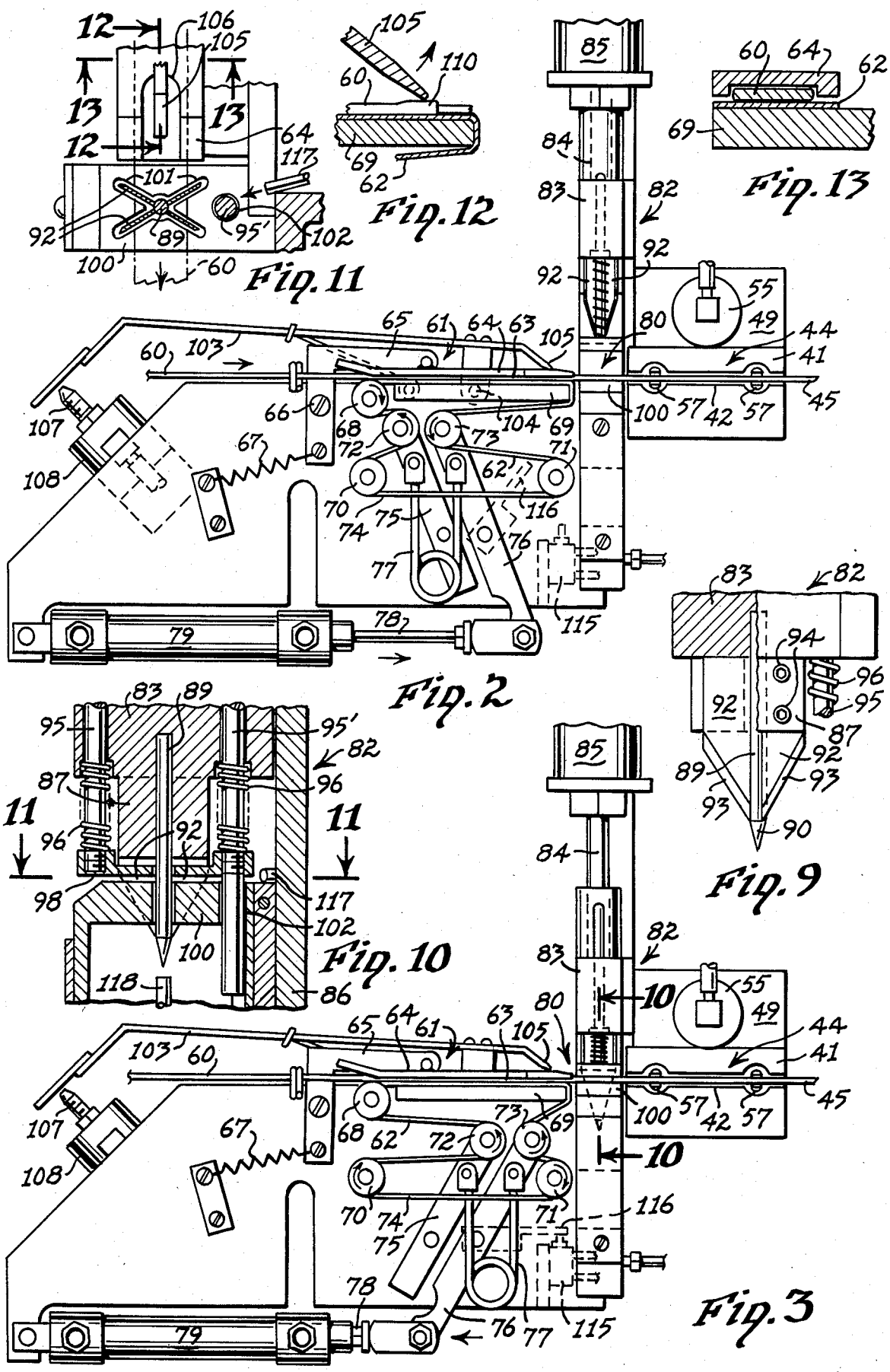
FIG. 2 is a fragmentary elevational view, taken along the line 2—2 of FIG. 1, of the belt web feeding apparatus, the loading assembly and the knife assembly, with the feeding device in operative position and the knife assembly in its inoperative position.
FIG. 3 is a view similar to FIG. 2, with the belt feed device in its inoperative position and the knife assembly in its operative position.
FIG. 9 is an enlarged fragmentary section taken along the line 9—9 of FIG. 6.
FIG. 10 is an enlarged fragmentary section taken along the line 10—10 of FIG. 3.
FIG. 11 is a fragmentary section taken along the line 11—11 of FIG. 10.
FIG. 12 is an enlarged fragmentary section taken along the line 12—12 of FIG. 11.
FIG. 13 is an enlarged fragmentary section taken along the line 13—13 of FIG. 11.

In order to form the belt loop strip 45, an elongated web of belt loop material 60 is fed toward, and in alignment with, the receiver slot 42 by a web feed device 61. The web feed device 61 disclosed in FIGS. 2 and 3 is substantially the same as that disclosed in FIGS. 13 and 14 of the Breck, Jr. U.S. Pat. No., 4,385,571. The web feed device 61 includes an endless belt 62 having an upper run 63 in contact with the bottom surface of the web 60. Engaged with the top surface of the web 60 and opposing the upper belt run 63 is a feed clamp plate 64 supported on an L-shaped bracket 65, pivotally mounted on the machine frame by pin 66, and urged into clamping engagement by the spring 67.

The endless feed belt 62 is trained about an upper fixed roller 68 and base plate 69 and about a pair of lower fixed rollers 70 and 71. Each of the rollers 48, 70 and 71 is provided with one-way clutches, not shown, so that the only turn in the feeding direction of the belt 62 and the web 60 towards the loading station 44.

A pair of movable rollers 72 and 73 are in contact with the belt 62 intermediate its upper run 63 and a lower run 74. Each of the movable rollers 72 and 73 is journaled on the upper end of corresponding pivotal arms 75 and 76, which are connected to a stiff spring 77 so that they move together in parallel relation.

The opposite or lower end of the front pivotal arm 76 is pivotally connected to the front end of a piston rod 78, which is reciprocably moved by the pneumatic cylinder 79.

The function of the web feeder device 61 is identical to that disclosed in the above Breck, Jr. U.S. Pat. No. 4,385,571. When the piston rod 78 is protracted as disclosed in FIG. 2, the upper run 63 of the belt 62 is caused to move forward or to the right of FIG. 2, to move the web 60 toward the loading station 44, by a uniform increment equal to the desired length of the belt loop strip 45.

When the piston rod 78 is retracted, as disclosed in FIG. 3, the movable belt rollers 72 and 73 move forward to move the lower belt run 74. However, the upper belt run 63 remains stationary to maintain the web 60 in a stationary position for cutting at the cutting station 80 between the loading station 44 and the feeder device 61, as best disclosed in FIGS. 1, 2 and 3.

Located at the cutting station 80 is the knife assembly 82, made in accordance with this invention.

The knife assembly 82 includes a knife head 83 fixed to a piston rod 84, depending from, and reciprocably driven by the pneumatic cylinder 85 supported upon a bracket 86 above the cutting station 80. Fixed to, and depending from the knife head 83 is a blade holder block 87 having a plurality of (specifically four) vertical blade receiving slots 88. These blade slots 88 radiate outwardly from the center of the holder block 87 in an X-configuration, as illustrated in FIG. 6. At the center or intersecting portion of the blade slots 88 is a depending blade support shaft 89. The blade support shaft 89 is of uniform diameter throughout most of its length, but is enlarged at its bottom end to form a retaining annular retainer flange 90 having a depending conical tip.

Received within each of the blade slots 88 is a knife blade 92 of uniform size and configuration. Each knife blade 92 is preferably flat or planar, having its upper portion, substantially rectangular, received within its respective slot 88. The lower portion of each blade 92 projects downward below its respective slot 88 and is substantially triangular-shaped, having a sharp knife edge 93 inclined or tapered downward and inward to converge and rest upon the ledge 90 of the blade support shaft 89. Each of the blades 92 is retained within its respective blade slot 88 by set screws 94.

As best disclosed in FIG. 6, the axes of the set screws 94 are preferably substantially parallel to each other, so that when tightened, against the blades 92, the set screws 94 tend to force each blade 92 toward the center of the holder block 87.

All four of the knife blades 92 are identical in shape and construction, so that they may be interchangeable with each other, or any one blade may be removed and replaced when excessively worn.

Projecting downward along both sides of the blade holder block 87 and slideable within the knife head 83 are a pair of vertical guide rods 95 and 95' surrounded by respective coil springs 96. A pressure plate 98 is fixedly mounted to both guide rods 95 and 95' below the holder block 87. The springs 96 urge the pressure plate 98 downward toward the web 60 in the cutting station 80.

The pressure plate 98 is provided with a set of guide slots 99 which are in vertical alignment with the knife blades 92, so that each of the guide slots 99 will permit free passage of a corresponding vertically aligned blade 92 therethrough. When the knife head 83 is driven downward, the knife blades 92 continue to move downward through the corresponding guide slots 99 after the downward motion of the pressure plate 98 has been arrested by engagement with the web 60 at the cutting station 80.

One of the guide rods 95' extends downward through a guide hole 102 in a fixed knife die or platen 100 upon which the web 60 rests in the cutting station 80. The platen 100 is also provided with a set of knife guide slots 101 identical in size and configuration and in vertical alignment with the knife slots 99 and the corresponding knife blades 92. Thus, when the knife blades 92 descend into cutting engagement with the web 60, the knife blades 92 pass through the corresponding slots 99 in the pressure plate 98 and the slots 101 in the knife die or platen 100.

Preferably, the web feed device 61 is provided with a seam sensing device including an elongated sensing arm 103 pivotally mounted on the feeder frame by pivot pin 104 and extending generally parallel to the feed direction. The front end of the sensing arm 103 includes an offset sensor finger 105 in longitudinal alignment with the web 106 and adjacent and slightly behind the cutting station 80. The sensor finger 105 is adapted to reciprocably move vertically within a slot 106 in the front end portion of the clamp plate 64, as best illustrated in FIGS. 1 and 11. The sensor finger 105 is biased toward engagement with the web 60, by spring 109 engaging sensing arm 103 (FIG. 1).

The rear end of the sensing arm 103 is mounted in close proximity above an air jet 107 and is adapted to close the jet 107 and actuate the air valve or switch 108 when the rear end of the arm 103 has been depressed by the elevation of the sensor finger 105 when the sensor finger 105 engages a seam 110 in the web 60, as best illustrated in FIG. 12. The actuation of the switch 108 will shut off the power source for actuating the motive means for the various elements in the machine 10, until the seam 110 has been removed from the web 60, and the power source re-actuated.

As best disclosed in FIG. 4, a limit switch 112 may be mounted on the knife bracket 86 in the path of a trip lug 113 projecting laterally from the knife head 83, for engagement and actuation when the knife head 83 is in its lowermost position. Actuation of the limit switch 112 reverses and the downward movement of the knife head 83 and causes it to stop in its "up" inoperative position after the web 60 has been cut by the blades 92.

Limit switch 115 may be provided in the web feed device 61 (FIGS. 2 and 3) for engagement by the switch arm 116 fixed to the front pivotal arm 76 when the movable rollers 72 and 73 are in their forward position (FIG. 3), and for disengagement when the rollers 72 and 73 commence their rearward movement. Actuation of the switch 115 actuates the cylinder 79 to protract the piston rod 78 to cause the feed device 61 to commence feeding the web 60 toward the loading station 44, as illustrated in FIG. 2.

Air jets 117 (FIG. 11) and 118 (FIG. 5) may be provided, if desired, to blow the cut fragments of fabric away after they have been severed from the two cut pieces of web material 60.

It is therefore apparent that a novel knife assembly 82 has been provided, which will not only transversely sever a web into two separate web portions, a leading web piece and a trailing web portion, but will simultaneously shear and trim the opposed lateral corner portions of the opposing cut web portions. Accordingly, the corner portions will be completely concealed when they are turned in during the belt loop forming operation, and after they are stitched upon themselves and upon the fabric 20 (FIG. 1).

What is claimed is:

1. In an apparatus for securing a belt loop to a garment including a securing station, a belt loop forming station, and feed means for feeding an elongated web of belt loop material in a feeding direction and path toward the forming station, a knife assembly for cutting the web fed to the forming station, comprising:

(a) a knife member, (b) means supporting said knife member for movement toward and transversely intersecting the path of the web in a cutting position, in advance of the belt loop forming station, for transversely securing said web into a leading web piece and a trailing web portion, (c) said knife member being adapted, in said cutting position, to simultaneously trim the opposite trailing corners of said leading web piece and the opposite leading corners of said trailing web portion.

2. The invention according to claim 1 in which said knife member has a first blade configuration diverging in the plane of the web in said feed direction for severing the trailing corner portions of said leading web piece and a second blade configuration on the trailing side of said first blade configuration diverging in the plane of said web in the opposite direction to the feed direction for severing the leading corner portions of said trailing web portion.

3. The invention according to claim 2 in which each of said blade configurations is V-shaped.

4. The invention according to claim 2 in which each of said blade configurations comprises blade portions diverging in said respective directions.

5. The invention according to claim 4 in which said means supporting said knife member comprises a head including means removably holding each of said blade portions independently of any other blade portion.

6. The invention according to claim 5 in which said means removably holding said blade portions comprises a plurality of slots in said head, each slot being adapted to receive a blade portion, said slots being in a substantial x-configuration having a center portion.

7. The invention according to claim 6 in which each of said blade portions has a cutting edge tapering downward and inward toward said center portion.

8. The invention according to claim 6 in which said blade portions depend below said head, and further comprising a pressure plate and means biasing said pressure plate downward into engagement with the top of said web passing beneath said knife member, said pressure plate having slots registering with the slots in said head for receiving the corresponding blades moving downward through the web in said cutting position.

9. The invention according to claim 8 further comprising a die block for supporting the web beneath said pressure plate, said die block having slots registering vertically with the slots in said pressure plate for receiving the passage of said corresponding blades in said cutting position.

10. The invention according to claim 5 further comprising means reciprocably moving said head between a lower cutting position and an upper inoperative position in which all of said blade portions are above the web passing beneath said knife member.

11. The invention according to claim 1 comprising said feed means, said feed means further comprising means for feeding the elongated web in uniform increments and for holding said web stationary while said knife member is in said cutting position, whereby uniform strips of belt loop material are formed and fed to the belt loop forming station, with trimmed corner portions.

12. The invention according to claim 11 further comprising seam detector means including a seam detector finger normally engaging the web in said feed path, and means responsive to said finger for stopping said feed means when said finger engages a transverse seam in said web.

* * * * *